US011703801B2

(12) United States Patent
Tschumi

(10) Patent No.: US 11,703,801 B2
(45) Date of Patent: Jul. 18, 2023

(54) DISCONNECTABLE CROWN

(71) Applicant: The Swatch Group Research and Development Ltd, Marin (CH)

(72) Inventor: Philipp Tschumi, Niederwil (CH)

(73) Assignee: The Swatch Group Research and Develonment Ltd, Marin (CH)

( * ) Notice: Subject to any disclaimer, the term of this patent is extended or adjusted under 35 U.S.C. 154(b) by 150 days.

(21) Appl. No.: 17/317,029

(22) Filed: May 11, 2021

(65) Prior Publication Data

US 2021/0373494 A1 Dec. 2, 2021

(30) Foreign Application Priority Data

Jun. 2, 2020 (EP) ..... 20177877

(51) Int. Cl.
*G04B 3/04* (2006.01)
*G04B 43/00* (2006.01)

(52) U.S. Cl.
CPC ..... *G04B 3/046* (2013.01); *G04B 43/002* (2013.01)

(58) Field of Classification Search
CPC ..... G04B 43/002; G04B 3/046; G04B 3/041; G04B 37/04; G04B 3/04; G04B 3/043; G04B 37/10
See application file for complete search history.

(56) References Cited

U.S. PATENT DOCUMENTS

2016/0070232 A1* 3/2016 Hiranuma ..... G04B 13/028 368/320
2018/0259906 A1* 9/2018 Iguchi ..... G04B 3/041

FOREIGN PATENT DOCUMENTS

| | | | |
|---|---|---|---|
| CH | 706 221 | A2 | 9/2013 |
| EP | 1 168 113 | A1 | 1/2002 |
| EP | 3 492 995 | A1 | 6/2019 |
| GB | 721920 | A | 1/1955 |
| JP | 1-180688 | U | 12/1989 |
| JP | 2010-243343 | A | 10/2010 |
| JP | 2015-68684 | A | 4/2015 |
| WO | 2013/054018 | A1 | 4/2013 |

OTHER PUBLICATIONS

European Search Report for EP 20177877 dated Oct. 20, 2020.

* cited by examiner

*Primary Examiner* — Edwin A. Leon
(74) *Attorney, Agent, or Firm* — Sughrue Mion, PLLC

(57) ABSTRACT

A shock-proof device (200) for a movement configured to allow the movement of the horological movement (210) along at least three degrees of freedom. The shock-proof device (200) includes at least one damping element (230) configured to damp the shocks of the horological movement (210) and a crown (100) configured to move between a first position (101) wherein the horological movement (210) is free along at least three degrees of freedom and a second position (102) wherein the horological movement (210) is rigidly connected to the crown (100).

15 Claims, 4 Drawing Sheets

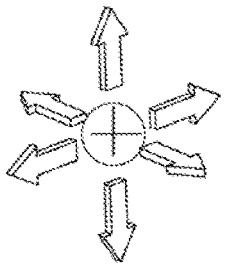
Fig. 1C
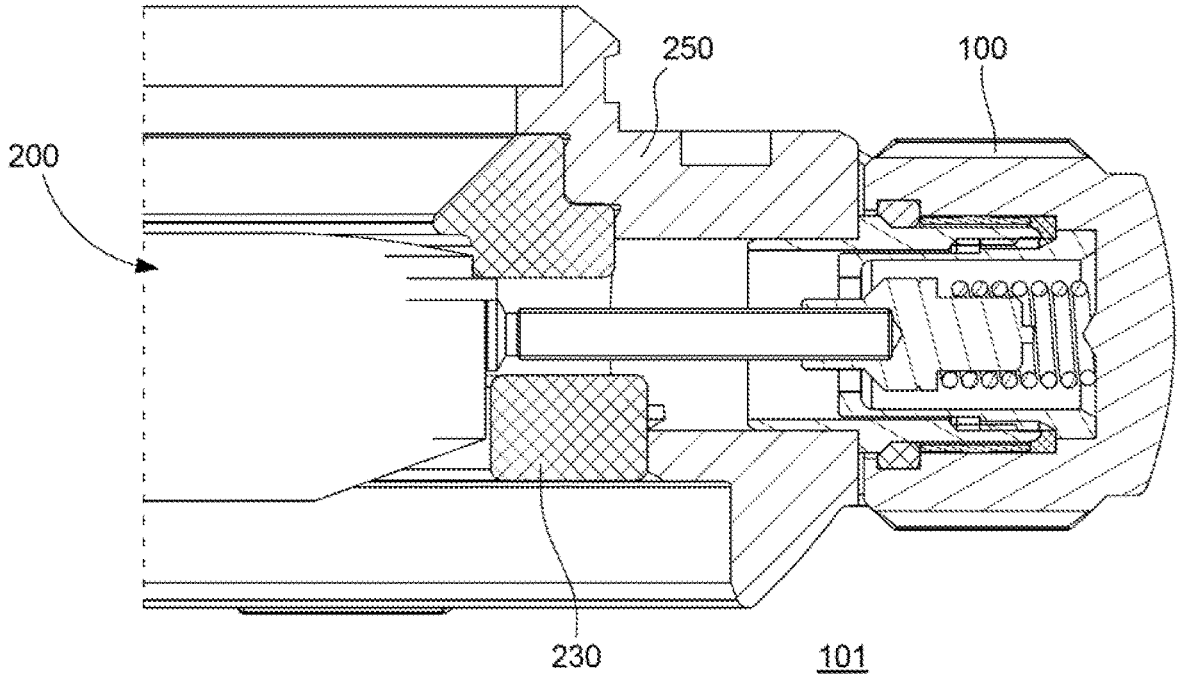

DISCONNECTABLE CROWN

CROSS-REFERENCE TO RELATED APPLICATIONS

This application claims priority to European Patent Application No. 20177877.6 filed Jun. 2, 2020, the entire contents of which are incorporated herein by reference.

TECHNICAL FIELD

The present invention relates to a shock-proof device for a horological movement and more particularly, a disconnectable crown capable of releasing said horological movement in the six degrees of freedom.

TECHNOLOGICAL BACKGROUND

The horological movement is subject to recurring shocks when a watch is worn. These shocks disrupt the functioning of said horological movement which can increase the inaccuracy thereof and result in losses of a few seconds.

SUMMARY OF THE INVENTION

The present invention proposes to resolve all or some of the drawbacks cited above by means of a crown for a shock-proof device, preferably a shock-proof device for a horological movement; said crown being configured to move between a first position wherein said horological movement is free along at least three degrees of freedom and a second position wherein said horological movement is rigidly connected to said crown; said crown comprising at least:

- A driven organ; said at least one driven organ being configured to be driven and to be connected to said horological movement; and,
- A driving organ; said at least one driving organ being configured to be distant from said at least one driven organ when said crown is in said first position and to be in contact with said at least one driven organ when said crown is in said second position.

Thanks to this arrangement, said crown makes it possible to release said horological movement in the six degrees of freedom such that, upon a shock, said horological movement can move in the case without being connected to the case.

According to an embodiment, said first position is a disconnected position wherein said at least one driving organ is distant from said at least one driven organ and said second position is a coupled position wherein said at least one driving organ is in contact with said at least one driven organ.

Thanks to this arrangement, said crown can couple or disconnect said at least one driven organ and said at least one driving organ.

According to an embodiment, said crown comprises an enclosure; said enclosure includes said at least one driven organ and/or said at least one driving organ.

According to an embodiment, said enclosure surrounds said at least one driven organ and/or said at least one driving organ, and/or said at least one driven organ surrounds said at least one driving organ.

Thanks to one or the other of these preceding arrangements, said enclosure can contain said at least one driven organ and said at least one driving organ.

According to an embodiment, said at least one driven organ comprises a head configured to offer an engagement to said at least one driving organ.

According to an embodiment, said head comprises a contact surface configured to offer an engagement to said at least one driving organ when said at least one driven organ is in contact with said at least one driving organ, and/or a guiding surface configured to guide said at least one driving organ, preferably, towards said contact surface.

Thanks to one or the other of these preceding arrangements, said at least one driven organ can be driven by said at least one driving organ when said crown is in said second position, preferably in said coupled position.

According to an embodiment, said at least one driving organ being configured to be distant from said contact surface when said crown is in said first position and/or said at least one driving member being configured to be in contact with said contact surface when said crown is in said second position.

Thanks to this arrangement, said at least one driving organ and said contact surface cooperate when said crown is in said second position.

According to an embodiment, said at least one driving organ has a cylindrical shape configured to engage with said at least one driven organ.

According to an embodiment, said cylindrical shape of said at least one driving organ forms a female match of said head of said at least one driven organ.

Thanks to one or the other of these preceding arrangements, there is a complementarity between said at least one driving organ and said at least one driven organ.

According to an embodiment, said crown comprises at least a first joint and at least one protective organ; said at least a first joint being disposed between said crown and at least one protective organ.

According to an embodiment, said at least a first joint is configured to render the space between said crown and said at least one protective organ water-resistant.

According to an embodiment, said at least one protective organ is disposed between said crown and said at least one driving organ.

According to an embodiment, said at least a first joint is always in contact with said crown and said at least one protective organ.

According to an embodiment, said crown comprises at least a second joint configured to be in contact with said crown and/or said at least one protective organ when said crown is in said first position and to be distant from said crown and/or said at least one protective organ when said crown is in said second position.

According to an embodiment, said at least a first joint is configured to render the space between said crown and said at least one protective organ water-resistant up to 30 bar, particularly up to 10 bar, preferably up to 5 bar.

Thanks to one or the other of these preceding arrangements, said crown is water-resistant while allowing freedom of movement for said horological movement.

According to an embodiment, said at least one driven organ is an end piece configured to be disposed on a shaft of said horological movement or said at least one driven organ is rigidly connected to a shaft of said horological movement.

According to an embodiment, said end piece comprises a contact surface configured to offer an engagement to said at least one driving organ when said at least one driven organ is in contact with said at least one driving organ, and/or a guiding surface configured to guide said at least one driving organ, preferably, towards said contact surface.

Thanks to one or the other of these preceding arrangements, said crown can be disposed on said horological movement.

According to an embodiment, said crown comprises at least one return organ configured to move said at least one driving organ between said first position and said second position.

According to an embodiment, said at least one return organ is disposed between said at least one driven organ and said at least one driving organ.

According to an embodiment, said at least one return organ is at least one spring.

Thanks to one or the other of these preceding arrangements, said at least one driven organ can be distanced from said at least one driving member.

According to an embodiment, said horological movement comprises a shaft; said at least one driven organ is integral with said shaft of said horological movement.

Thanks to one or the other of these preceding arrangements, said crown can be integrated on said shaft of said horological movement during the assembly of said horological movement and/or during the manufacture of said shaft.

The present invention relates to a shock-proof device for a movement, preferably a horological movement; said shock-proof device being configured to allow the movement of said horological movement along at least three degrees of freedom; said shock-proof device comprising said horological movement, a crown according to the present invention, said crown being configured to move between a first position wherein said horological movement is free along at least three degrees of freedom and a second position wherein said horological movement is rigidly connected to said crown, and at least one damping element configured to damp the shocks of said horological movement.

According to an embodiment, said at least one damping element is configured to damp the shocks of said horological movement when the crown is in the first position.

Thanks to this arrangement, said crown can couple or disconnect said at least one driven organ and said at least one driving organ, and said horological movement can move along the 6 degrees of freedom without being impeded and be damped by said at least one damping element.

According to an embodiment, said shaft is a winding-mechanism shaft.

According to an embodiment, said shock-proof device comprises a middle configured to receive said horological movement protected by said damping element.

Thanks to this arrangement, said horological movement can move along the 6 degrees of freedom in said middle without being impeded and be damped by said at least one damping element.

BRIEF DESCRIPTION OF THE FIGURES

The invention will be described hereinafter in more detail using the appended drawings, given as non-restrictive examples, wherein:

FIGS. 1A, 1B and 10 show, respectively, a shock-proof device 200, a crown 100 and a sectional view of said shock-proof device 200 in a first position 101 according to an embodiment of the invention; and, FIGS. 2A, 2B and 2C show, respectively, said shock-proof device 200, said crown 100 and a sectional view of said shock-proof device 200 in a first position 101 according to an embodiment of the invention.

DETAILED DESCRIPTION OF THE INVENTION

Figure 1A:
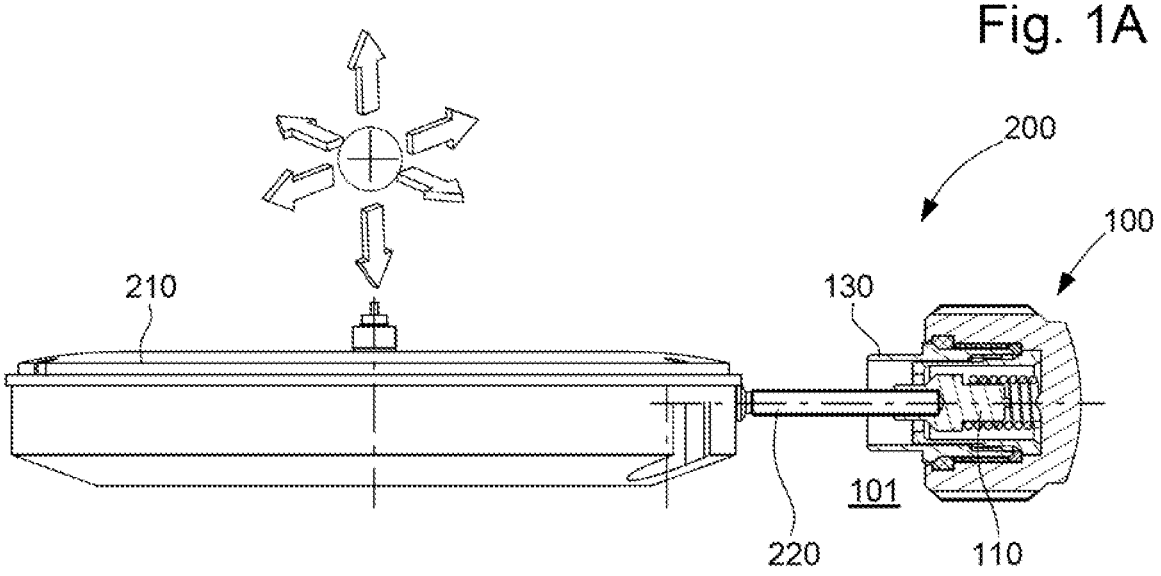

FIG. 1A shows a shock-proof device 200 configured to allow the movement of a horological movement 210 along at least three degrees of freedom, preferably along six degrees of freedom.

Said shock-proof device 200 comprises said horological movement 210, a crown 100 connected by a shaft 220, preferably a winding-mechanism shaft 220, to said horological movement 210 and a middle 250.

Said middle 250 includes at least one damping element 230 which can completely or partially cover the inside of said middle 250 and is configured to damp the shocks of said horological movement 210 when said horological movement 210 moves along at least one of the 6 degrees of freedom in said middle 250.

Indeed, as seen in FIG. 10, said at least one damping element 230 can damp the shocks of said horological movement 210 when said crown 100 is contact with or near said middle 250, as said horological movement 210 can move along the 6 degrees of freedom without being impeded but while being damped by said at least one damping element 230.

Figure 1B:
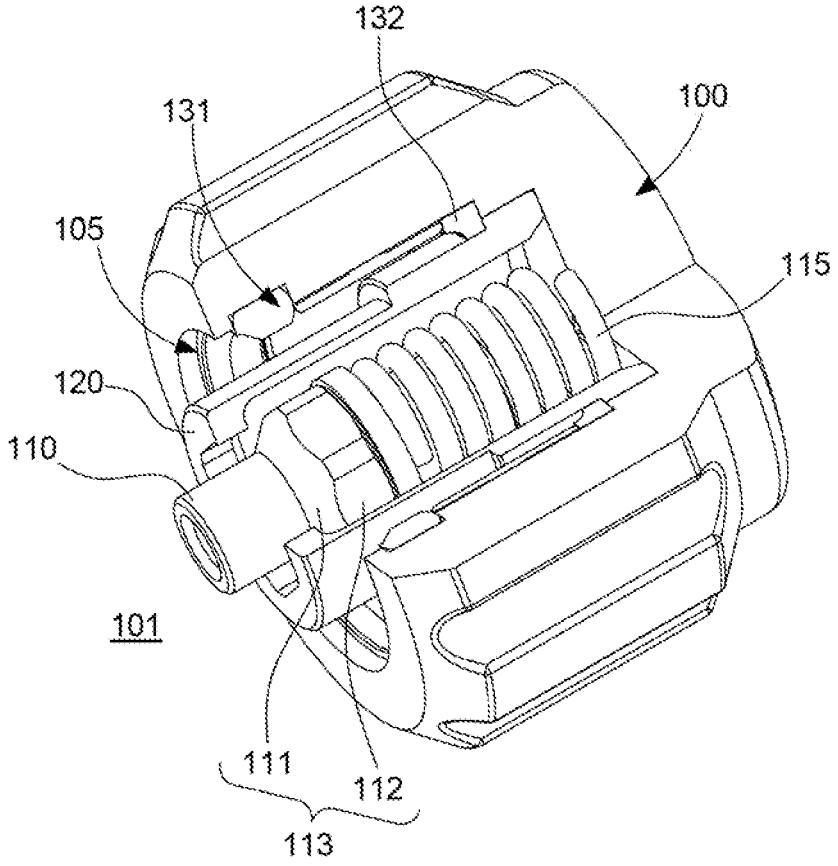
Figure 2A:
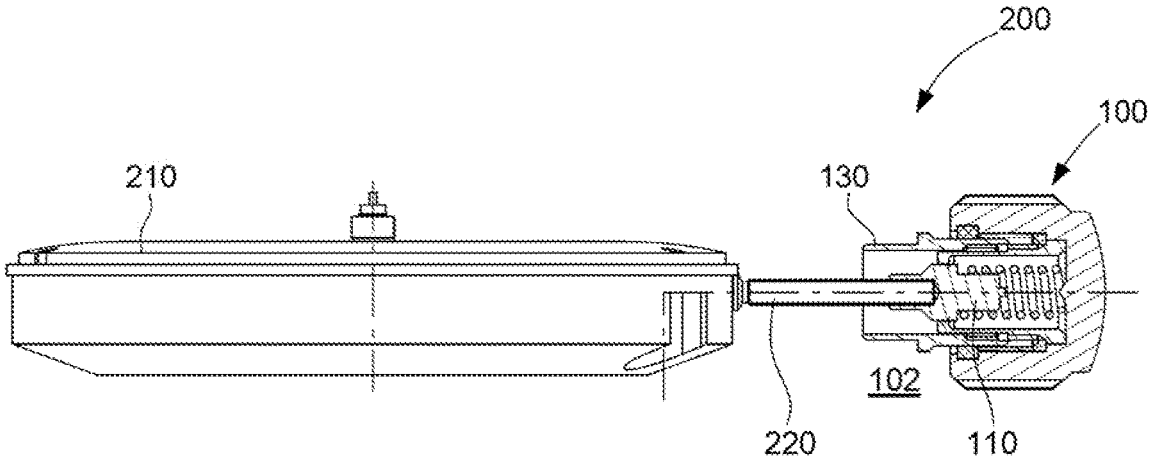
Figure 2B:
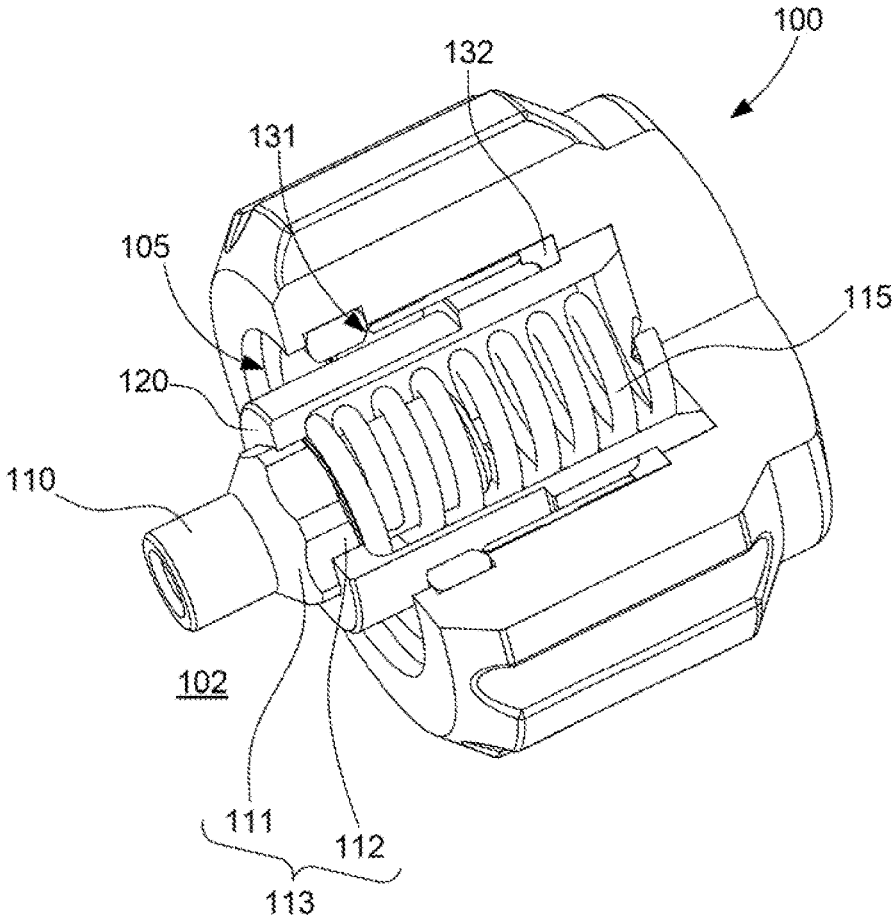

Represented in FIGS. 1B and 2B, said crown 100 can comprise at least one driving organ 120 and at least one driven organ 110 configured to be driven and to be connected to said horological movement 210 by said shaft 220.

Said crown 100 also includes an enclosure 105 configured to receive said at least one driven organ 110 and/or said at least one driving organ 120. More specifically, said enclosure 105 surrounds said at least one driving organ 120, which in turn surrounds said at least one driven organ 110 such that said enclosure 105 contains said at least one driven organ 110 and said at least one driving organ 120.

When said at least one driving organ 120 is placed or is located in said enclosure 105 of said crown 100, there is a space wherein at least one protective organ 130, preferably a tube 130, can slot into or be inserted. In other words, said at least one protective organ 130 is disposed between said crown 100 and said at least one driving organ 120.

For water-resistance reasons, said crown 100 comprises at least a first joint 131 and at least a second joint 132. Said at least a first joint 131 can be disposed between said crown 100 and said at least one protective organ 130, in other words, said at least a first joint 131 is configured to render the space between said crown 100 and said at least one protective organ 130 water-resistant.

As is noteworthy in the different figures, said at least a first joint 131 can always be in contact with said crown 100 and at least one protective organ 130, and can be configured to render said space water-resistant up to 30 bar, particularly up to 10 bar, preferably up to 5 bar.

Moreover, said crown 100 is configured to move between a first position 101 and a second position 102, more particularly and given that said at least one driving organ 120 is rigidly connected to said crown 100, it is said at least one driving organ 120, which is configured to move between a first position 101 and a second position 102.

In said first position 101 also referred to as disconnected position 101, said horological movement 210 is free along at least three degrees of freedom, preferable along six degrees of freedom, FIGS. 1A and 10, and the movements thereof, even the shocks thereof with said middle 250, are completely and partially damped by said at least one damping element 230 completely or partially covering said middle 250. In this disconnected position 101, i.e. in said first position 101, said at least one driving organ 120 is distant from said at least one driven organ 110, but said crown 100 can be in contact with or near said middle 250 and/or said at least one protective organ 130.

As seen in FIG. 1A, and more particularly in FIG. 10, said at least one protective organ 130, preferably said tube 130 is in contact with said crown 100 by means of at least a second joint 132. Indeed, said at least one protective organ 130 can be in contact with said at least a second joint 132 when said at least one driving organ 120 is distant from said at least one driven organ 110.

Figure 2C:
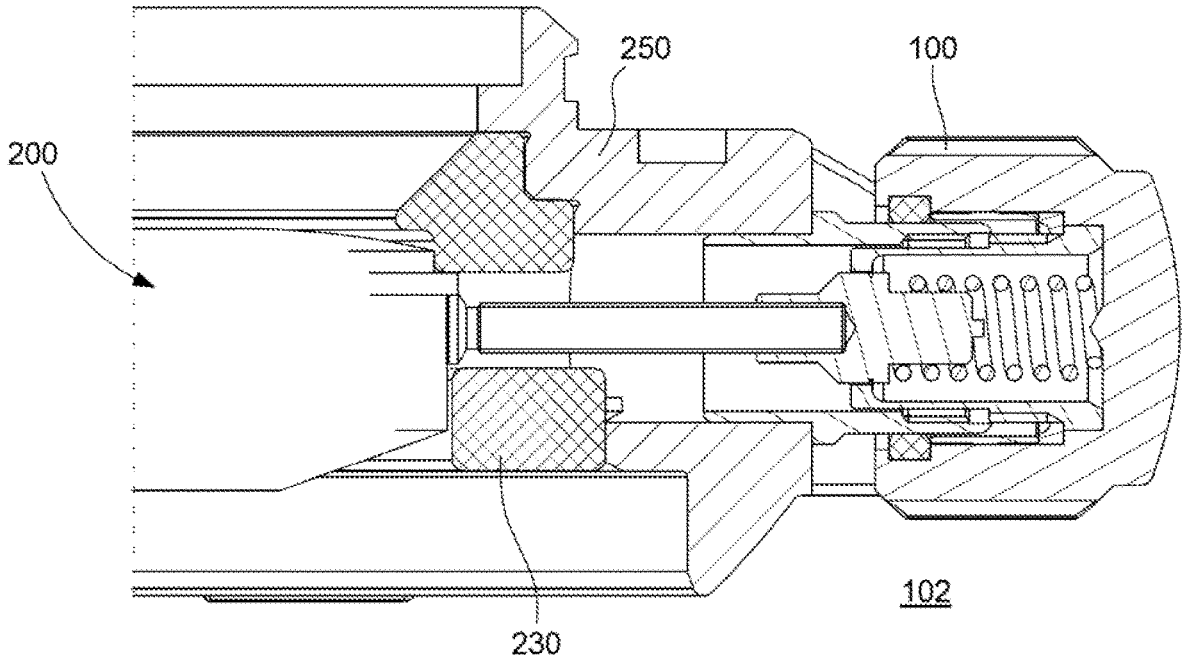

When the user wishes to wind their watch, said crown 100 is moved towards said second position 102, i.e. said crown 100 is moved away from said middle 250, and horological movement 210 becomes rigidly connected to said crown 100, FIG. 2C. Simultaneously, said at least a second joint 132 is moved away, by means of said crown 100, from said at least one protective organ 130, FIG. 2B.

This movement from said first position 101 towards said second position 102 can be facilitated by at least one return organ 115, optionally taking the form of at least one spring 115, comprised between said crown 100, preferably said at least one driving organ 120, and said at least one driven organ 110, so as to distance said crown 100 from said middle 250 but to bring said at least one driven organ 110 and said at least one driving organ 120 into contact, FIG. 2B.

Said at least one driven organ 110, optionally taking the form of a post 110 or an end piece 113, can comprise a head 113 configured to offer an engagement to said at least one driving organ 120. Moreover, according to the embodiments, said head 113 of said at least one driven organ 110 can be integral, or rigidly connected, with said shaft 220 of said horological movement 210 or, in the form of said end piece 113, can be fitted onto the shaft 220.

Furthermore, said head 113 comprises a contact surface 112 and a guiding surface 111 configured to guide said at least one driving organ 120 towards said contact surface 112, when said driving organ 120 moves from said first position 101 towards said second position 102, also referred to as coupling position 102.

This cooperation or this driving of said at least one driven organ 110 by said at least one driving organ 120 may be permitted by the cylindrical shape of said at least one driving organ 120 which surrounds said at least one driven organ 110 and more particularly, by the engagement offered by said contact surface 112 to said at least one driving organ 120. More specifically, said cylindrical shape of said at least one driving organ 120 forms a female match of said head 113 of said at least one driven organ 110, such that a complementarity between said at least one driving organ 120 and said at least one driven organ 110 is possible, in the manner of a tube wrench and a hexagonal bolt for example.

In the coupling position 102, i.e. in said second position 102, the user can wind said horological movement 210.

The invention claimed is:

1. A shock-proof device for a horological movement (210), said shock-proof device, comprising:

said horological movement;

a crown (100) configured to move between a first position (101) wherein said horological movement (210) is free along at least three degrees of freedom and a second position (102) wherein said horological movement (210) is rigidly connected to said crown (100);

a driven organ (110) configured to be driven and to be connected to said horological movement (210);

a driving organ (120) configured to be distant from said driven organ (110) when said crown (100) is in said first position (101) and to be in contact with said driven organ (110) when said crown (100) is in said second position (102); and a damping element (230) configured to damp shocks of said horological movement.

2. The shock-proof device according to claim 1, further comprising an enclosure (105); said enclosure (105) includes said driven organ (110) and/or said driving organ (120).

3. The shock-proof device according to claim 2, wherein said enclosure (105) surrounds said driven organ (110) and/or said driving organ (120), and/or said driven organ (110) surrounds said driving organ (120).

4. The shock-proof device according to claim 1, wherein said driven organ (110) comprises a head (113) configured to offer an engagement to said driving organ (120).

5. The shock-proof device according to claim 4, wherein said head (113) comprises a contact surface (112) configured to offer an engagement to said driving organ (120) when said driven organ (110) is in contact with said driving organ (120), and/or a guiding surface (111) configured to guide said driving organ (120), preferably, towards said contact surface (112).

6. The shock-proof device according to claim 5, wherein said driving organ (120) being configured to be distant from said contact surface (112) when said crown (100) is in said first position (101) and/or said driving organ (120) being configured to be in contact with said contact surface (112) when said crown (100) is in said second position (102).

7. The shock-proof device according to claim 1, wherein said driving organ (120) has a cylindrical shape configured to engage with said driven organ (110).

8. The shock-proof device according to claim 7, wherein said cylindrical shape of said driving organ (120) forms a female match of said head (113) of said driven organ (110).

9. The shock-proof device according to claim 1, which comprises at least a first joint (131) and a protective organ; said at least a first joint (131) being disposed between said crown (100) and said protective organ (130).

10. The shock-proof device according to claim 9, wherein said at least a first joint (131) is configured to render the space between said crown (100) and said protective organ (130) water-resistant.

11. The shock-proof device according to claim 1, wherein said driven organ (110) is an end piece (110) configured to be disposed on a shaft (220) of said horological movement (210) or said driven organ (110) is rigidly connected to a shaft (220) of said horological movement (210).

12. The shock-proof device according to claim 1, further comprising a return organ (115) configured to move said driving organ (120) between said first position (101) and said second position (102).

13. The shock-proof device according to claim 11, wherein said shaft (220) is a winding-mechanism shaft (220).

14. The shock-proof device according to claim 1, which comprises a middle (250) configured to receive said horological movement (210) protected by said damping element (230).

15. The shock-proof device according to claim 1, wherein the driving organ (120) is a cylindrical female member and the driven organ (110) is a cylindrical male member which is engaged by the cylindrical female member by being received in the female member.

* * * * *